US011441777B2

(12) United States Patent
Corsmeier

(10) Patent No.: US 11,441,777 B2
(45) Date of Patent: Sep. 13, 2022

(54) COMBUSTOR HEAT SHIELD AND ATTACHMENT FEATURES

(71) Applicant: General Electric Company, Schenectady, NY (US)

(72) Inventor: Donald Michael Corsmeier, West Chester, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 16/686,447

(22) Filed: Nov. 18, 2019

(65) Prior Publication Data

US 2020/0080723 A1 Mar. 12, 2020

Related U.S. Application Data

(63) Continuation of application No. 15/281,673, filed on Sep. 30, 2016, now Pat. No. 10,495,310.

(51) Int. Cl.

| | |
|---|---|
| ***F23R 3/00*** | (2006.01) |
| ***F23R 3/28*** | (2006.01) |
| ***F23R 3/60*** | (2006.01) |

(52) U.S. Cl.

CPC ..... *F23R 3/002* (2013.01); *F23R 3/007* (2013.01); *F23R 3/283* (2013.01); *F23R 3/60* (2013.01); *F23R 2900/00012* (2013.01)

(58) Field of Classification Search

CPC ..... F23R 3/002; F23R 3/007; F23R 3/283; F23R 3/28; F23R 3/60; F23R 2900/00012

See application file for complete search history.

(56) References Cited

U.S. PATENT DOCUMENTS

| | | | | |
|---|---|---|---|---|
| 4,934,145 | A | 6/1990 | Zeisser | |
| 5,117,637 | A * | 6/1992 | Howell | F23R 3/283 60/740 |
| 5,291,733 | A | 3/1994 | Halila | |
| 5,463,864 | A | 11/1995 | Butler et al. | |
| 7,464,554 | B2 | 12/2008 | Cheung et al. | |
| 8,756,935 | B2 | 6/2014 | Duval et al. | |
| 8,763,406 | B2 | 7/2014 | Pieussergues et al. | |

(Continued)

FOREIGN PATENT DOCUMENTS

| | | |
|---|---|---|
| FR | 2825778 A1 | 12/2002 |
| FR | 2935465 A1 | 3/2010 |

*Primary Examiner* — Steven M Sutherland

(74) *Attorney, Agent, or Firm* — Dority & Manning, P.A.

(57) ABSTRACT

Combustor assemblies are provided. For example, a combustor assembly includes a combustor liner defining a combustion chamber and an annular combustor dome positioned at a forward end of the combustor liner that defines a plurality of dome apertures. The combustor assembly further includes an annular heat shield positioned between the combustor dome and the combustion chamber, a plurality of adapters positioned forward of the heat shield, and a plurality of collars. The heat shield defines a plurality of heat shield apertures that are aligned with the dome apertures. One adapter is attached to the combustor dome at each dome aperture, and the adapters are. One collar extends through each heat shield aperture to couple the heat shield to the combustor dome. Further, ceramic matrix composite (CMC) heat shields are provided that may include an annular body defining a plurality of heat shield apertures, as well as inner and outer wings.

6 Claims, 12 Drawing Sheets

(56) References Cited

U.S. PATENT DOCUMENTS

| | | | | |
|---|---|---|---|---|
| 8,943,835 | B2 | 2/2015 | Corsmeier et al. | |
| 2008/0060360 | A1* | 3/2008 | Stastny | F23R 3/10 60/752 |
| 2010/0194179 | A1 | 8/2010 | Waltz | |
| 2011/0271684 | A1 | 11/2011 | Corsmeier et al. | |
| 2013/0192262 | A1* | 8/2013 | Eastwood | F23R 3/002 60/805 |
| 2014/0026580 | A1 | 1/2014 | Pardington et al. | |
| 2015/0107109 | A1 | 4/2015 | Corsmeier et al. | |
| 2015/0260404 | A1 | 9/2015 | Sullivan | |
| 2015/0354820 | A1* | 12/2015 | Vetters | F23R 3/60 60/796 |
| 2015/0362191 | A1* | 12/2015 | Papple | F23R 3/002 60/772 |

* cited by examiner

COMBUSTOR HEAT SHIELD AND ATTACHMENT FEATURES

CROSS-REFERENCE TO RELATED APPLICATIONS

This application is a continuation of and claims priority to U.S. application Ser. No. 15/281,673, filed Sep. 30, 2016, the contents of which are incorporated herein by reference.

FIELD OF THE INVENTION

The present subject matter relates generally to combustor assemblies of gas turbine engines. More particularly, the present subject matter relates to combustor heat shields and features for attaching a heat shield to a combustor assembly of a gas turbine engine.

BACKGROUND OF THE INVENTION

A gas turbine engine generally includes a fan and a core arranged in flow communication with one another. Additionally, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gases through the turbine section drives the turbine section and is then routed through the exhaust section, e.g., to atmosphere.

Combustion gas temperatures are relatively hot, such that some components in or near the combustion section and the downstream turbine section require features for deflecting or mitigating the effects of the combustion gas temperatures. For example, one or more heat shields may be provided on a combustor dome to help protect the dome from the heat of the combustion gases. However, such heat shields often require cooling themselves, e.g., through a flow of cooling fluid directed against the heat shields, which can negatively impact turbine emissions. Further, turbine performance and efficiency generally may be improved by increasing combustion gas temperatures. Therefore, there is an interest in providing heat shields that can withstand increased combustion gas temperatures yet also require less cooling, to increase turbine performance and efficiency while also reducing turbine emissions.

Non-traditional high temperature materials, such as ceramic matrix composite (CMC) materials, are more commonly being used for various components within gas turbine engines. For example, because CMC materials can withstand relatively extreme temperatures, there is particular interest in replacing components within the flow path of the combustion gases, such as combustor dome heat shields, with CMC materials. Nonetheless, typical CMC heat shields have complex shapes that are difficult to fabricate, often requiring complex or special tooling, and are difficult to assemble with the combustor dome, usually requiring numerous intricate metal pieces to properly assemble the heat shields with the dome.

Accordingly, improved combustor heat shields and features for attaching heat shields within combustor assemblies that overcome one or more disadvantages of existing designs would be desirable. For example, an annular heat shield for a combustor assembly would be beneficial. In particular, a combustor assembly having an annular heat shield positioned between a combustor dome and a combustion chamber of the combustor assembly would be useful. Further, a collar for attaching a heat shield to a combustor dome would be helpful. Additionally, an annular heat shield comprising a plurality of segments or one or more rings would be advantageous.

BRIEF DESCRIPTION OF THE INVENTION

Aspects and advantages of the invention will be set forth in part in the following description, or may be obvious from the description, or may be learned through practice of the invention.

In one exemplary embodiment of the present disclosure, a combustor assembly for a gas turbine engine is provided. The combustor assembly includes a combustor liner defining a combustion chamber and an annular combustor dome positioned at a forward end of the combustor liner. The combustor dome defines a plurality of dome apertures. The combustor assembly further includes an annular heat shield positioned between the combustor dome and the combustion chamber. The heat shield defines a plurality of heat shield apertures, and the plurality of heat shield apertures are aligned with the dome apertures. The combustor assembly also includes a plurality of adapters. One adapter is attached to the combustor dome at each dome aperture, and the adapters are positioned forward of the heat shield. Further, the combustor assembly includes a plurality of collars. One collar extends through each heat shield aperture to couple the heat shield to the combustor dome.

In another exemplary embodiment of the present disclosure, a ceramic matrix composite (CMC) heat shield for a combustor assembly is provided. The CMC heat shield includes an annular body that defines a plurality of heat shield apertures. The body has an inner perimeter, an outer perimeter, a forward surface, and an aft surface. The CMC heat shield further includes an inner wing extending axially aft and circumferentially along the inner perimeter of the body and an outer wing extending axially aft and circumferentially along the outer perimeter of the body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
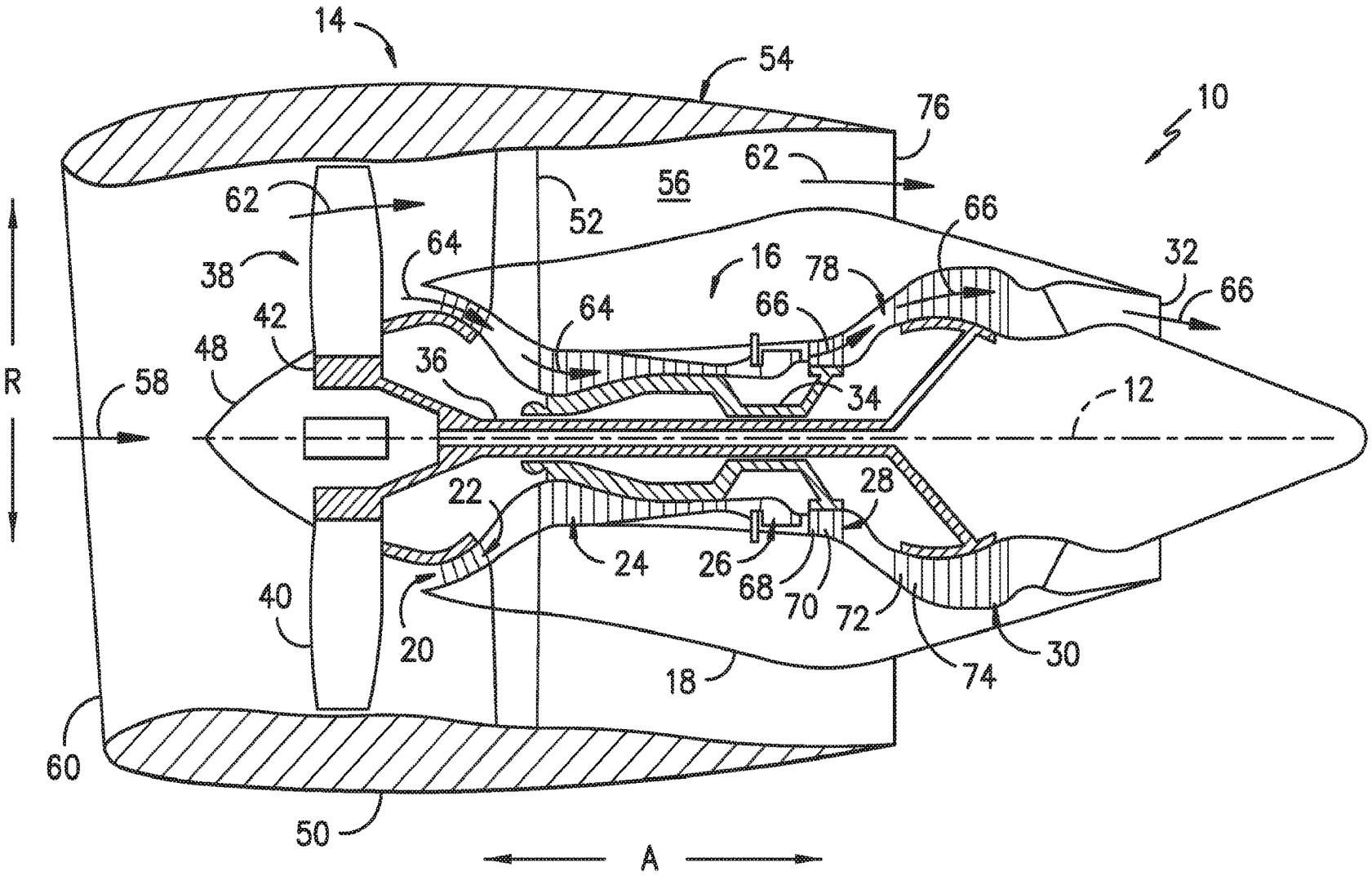
FIG. 1 provides a schematic cross-section view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the depicted embodiment, fan section 14 includes a fan 38 having a plurality of fan blades 40 coupled to a disk 42 in a spaced apart manner. As depicted, fan blades 40 extend outward from disk 42 generally along the radial direction R. The fan blades 40 and disk 42 are together rotatable about the longitudinal axis 12 by LP shaft 36. In some embodiments, a power gear box having a plurality of gears may be included for stepping down the rotational speed of the LP shaft 36 to a more efficient rotational fan speed.

Referring still to the exemplary embodiment of FIG. 1, disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters turbofan 10 through an associated inlet 60 of the nacelle 50 and/or fan section 14. As the volume of air 58 passes across fan blades 40, a first portion of the air 58 as indicated by arrows 62 is directed or routed into the bypass airflow passage 56 and a second portion of the air 58 as indicated by arrows 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

Figure 2:
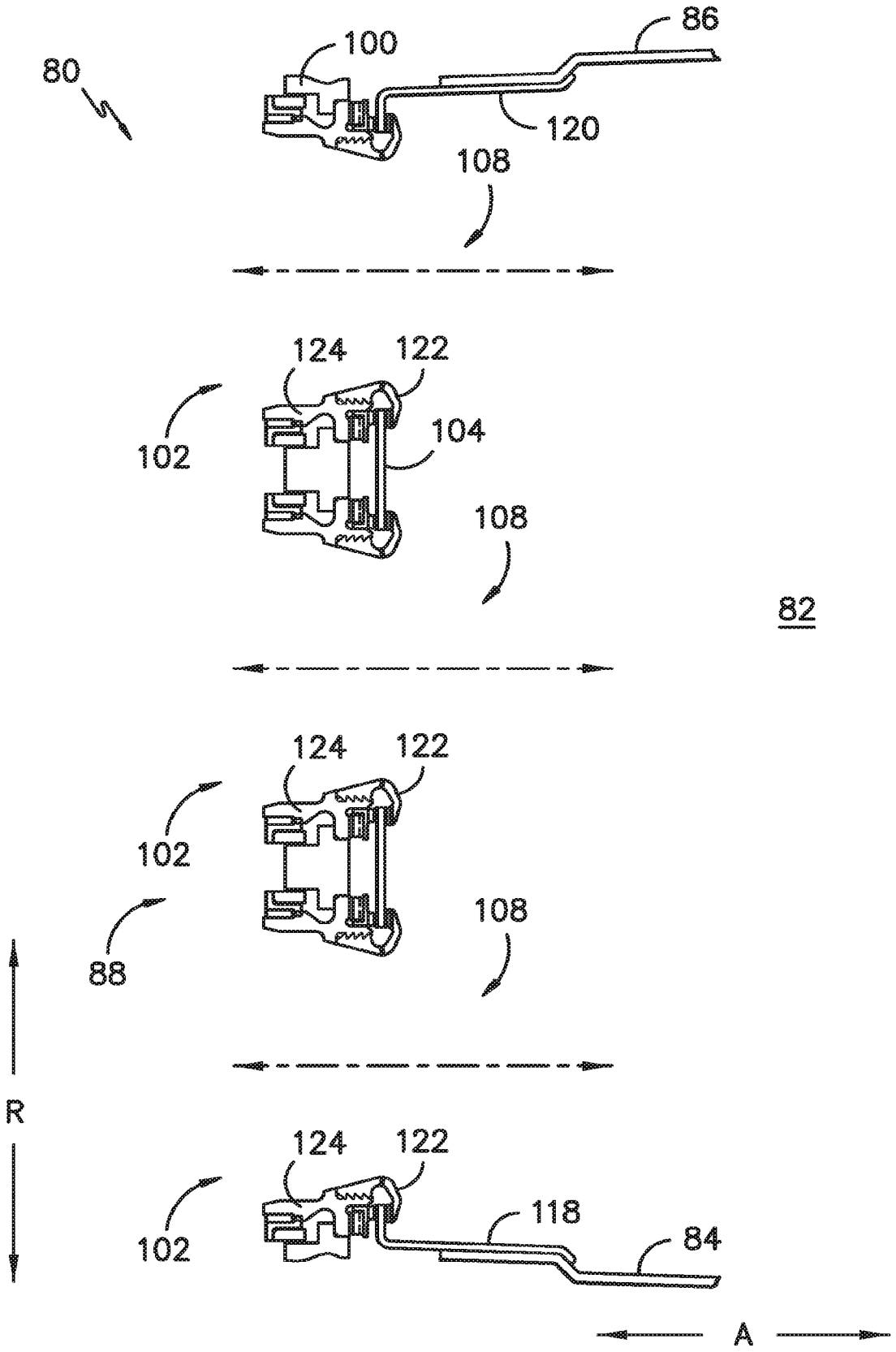
FIG. 2 provides a schematic cross-section view of a portion of a combustor assembly according to an exemplary embodiment of the present subject matter.

Referring now to FIG. 2, a schematic, cross-sectional view is provided of a portion of a combustor assembly 80 according to an exemplary embodiment of the present subject matter. More particularly, FIG. 2 provides a side, cross-sectional view of an exemplary combustor assembly 80, which may, for example, be positioned in the combustion section 26 of the exemplary turbofan engine 10 of FIG. 1.

Combustor assembly 80 depicted in FIG. 2 generally includes a combustion chamber 82 defined by a combustor liner comprising an inner liner 84 and an outer liner 86. That is, inner and outer liners 84, 86 together at least partially define combustion chamber 82 therebetween. Further, combustor assembly 80 extends generally along the axial direction A from a forward end 88 to an aft end (not shown).

The inner and outer liners 84, 86 are each attached to an annular combustor dome 100 at the forward end 88 of combustor assembly 80. More particularly, the combustor dome 100 is positioned at a forward end 88 of the combustor liner, and the combustor dome 100 extends along a circumferential direction C (FIG. 3) to define an annular shape. In some embodiments, the combustor dome 100 may comprise an inner dome section attached to inner liner 84 and an outer dome section attached to outer liner 86, where each of the inner and outer dome sections extend along the circumferential direction C to define an annular shaped combustor dome. The combustor dome 100 may have other configurations as well.

Combustor assembly 80 defines a plurality of apertures 102 therein, the dome apertures 102 spaced apart from one another along the radial direction R and the circumferential direction C. A plurality of fuel-air mixers (not shown) spaced along the circumferential direction C may be positioned at least partially within the dome 100. For example, a fuel-air mixer may be disposed at least partially within each dome aperture 102, or within a portion of the dome apertures 102. In other embodiments, the fuel-air mixers may be positioned just upstream or forward of the dome apertures 102. Compressed air from the compressor section of the turbofan engine 10 flows into or through the fuel-air mixers, where the compressed air is mixed with fuel and ignited to create the combustion gases 66 within the combustion chamber 82. The combustor dome 100 may be configured to assist in providing the flow of compressed air from the compressor section into or through the fuel-air mixers. For example, combustor dome 100 may include an inner cowl and an outer cowl that assist in directing the flow of compressed air from the compressor section into or through one or more of the fuel-air mixers.

Referring still to FIG. 2, the exemplary combustor assembly 80 further includes a heat shield 104 positioned downstream or aft of the combustor dome 100 such that the heat shield 104 is positioned between the combustor dome 100 and the combustion chamber 82. The exemplary heat shield 104 is an annular heat shield that extends radially from inner liner 84 to outer liner 86. As described in greater detail below, the heat shield 104 extends circumferentially about combustor assembly 80 and is configured to protect certain components of the turbofan engine 10, such as combustor dome 100, from the relatively extreme temperatures of the combustion chamber 82.

In some embodiments, components of turbofan engine 10, particularly components within hot gas path 78 such as components of combustion assembly 80, may comprise a ceramic matrix composite (CMC) material, which is a non-metallic material having high temperature capability. Exemplary CMC materials utilized for such components may include silicon carbide (SiC), silicon, silica, or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). For example, in certain embodiments, bundles of the fibers, which may include a ceramic refractory material coating, are formed as a reinforced tape, such as a unidirectional reinforced tape. A plurality of the tapes may be laid up together (e.g., as plies) to form a preform component. The bundles of fibers may be impregnated with a slurry composition prior to forming the preform or after formation of the preform. The preform may then undergo thermal processing, such as a cure or burn-out to yield a high char residue in the preform, and subsequent chemical processing, such as melt-infiltration with silicon, to arrive at a component formed of a CMC material having a desired chemical composition. In other embodiments, the CMC material may be formed as, e.g., a carbon fiber cloth rather than as a tape.

As stated, components comprising a CMC material may be used within the hot gas path 78, such as within the combustion and/or turbine sections of engine 10. However, CMC components may be used in other sections as well, such as the compressor and/or fan sections. As a particular example described in greater detail below, a heat shield 104 for combustor dome 100 may be formed from a CMC material to provide protection to the dome from the heat of the combustion gases, e.g., without requiring cooling from a flow of cooling fluid as is usually required for metal heat shields.

Figure 3:
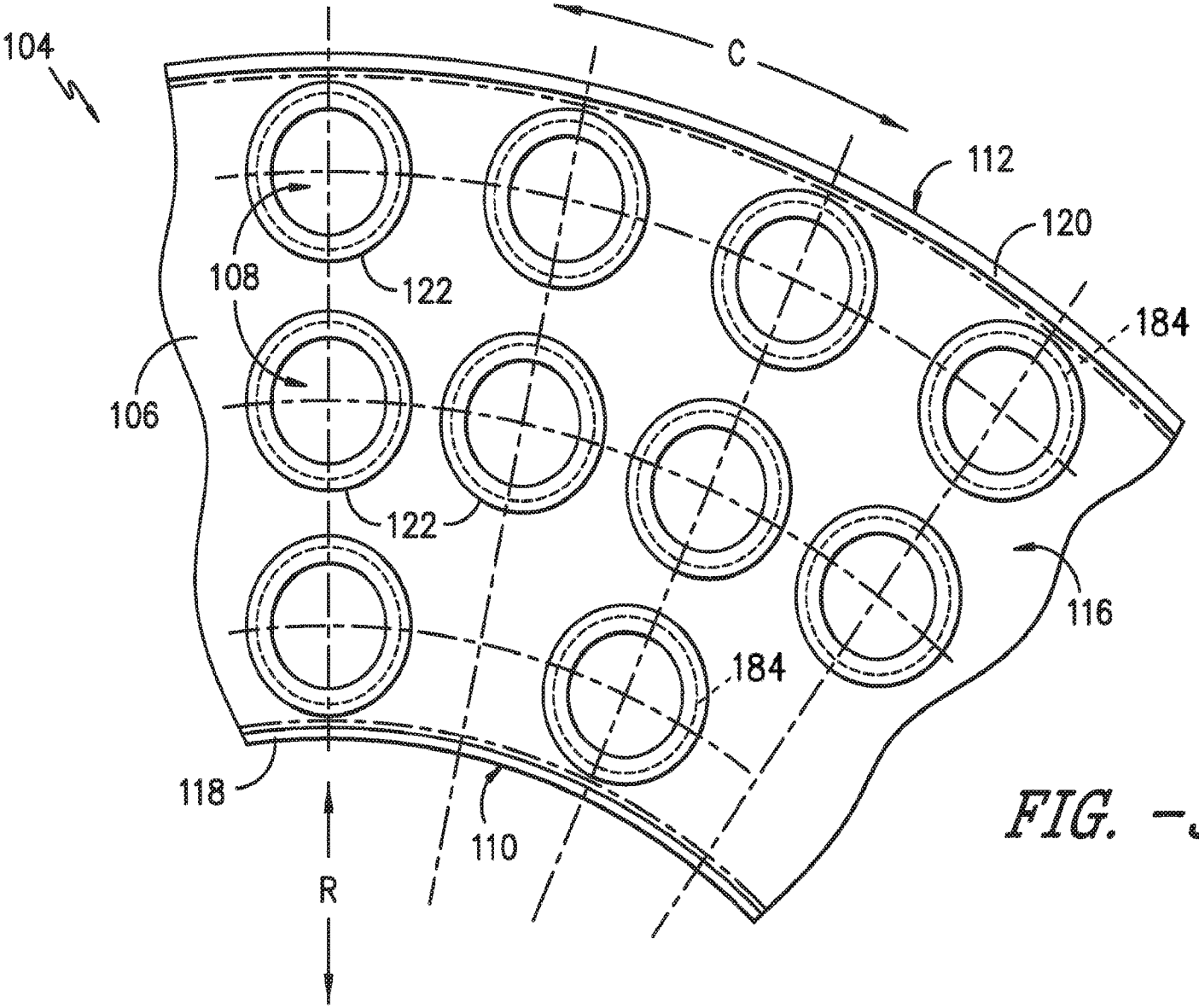
FIG. 3 provides an aft end view of a portion of a heat shield of the combustor assembly of FIG. 2, according to an exemplary embodiment of the present subject matter.

Turning now to FIG. 3, an aft end view is provided of a portion of a CMC heat shield 104 according to an exemplary embodiment of the present subject matter. That is, the exemplary heat shield 104 is made from a CMC material, such as the CMC materials described above. As shown in FIG. 3, the exemplary heat shield 104 extends along the circumferential direction C, and as previously described, the heat shield 104 extends circumferentially about the combustor assembly 80 and has a generally annular shape. More particularly, the heat shield 104 comprises an annular body 106 that defines a plurality of heat shield apertures 108. Like the dome apertures 102, the heat shield apertures 108 are spaced apart from one another along the radial direction R and the circumferential direction C.

Keeping with FIG. 3, the body 106 of heat shield 104 includes an inner perimeter 110 and an outer perimeter 112. The body 106 further includes a forward surface 114 (FIG. 2) that faces the combustor dome 100 and an aft surface 116 that faces the combustion chamber 82. As shown in FIG. 3, and more clearly in FIG. 2, the body 106 of the depicted exemplary heat shield 104 also includes an inner wing 118 along the inner perimeter 110 of the body, as well as an outer wing 120 along the outer perimeter 112 of the body. Each of the inner wing 118 and the outer wing 120 extend aft along the axial direction A, as well as along the circumferential direction C as each extends along the respective inner and outer perimeter 110, 112 of the body 106.

Figure 4:
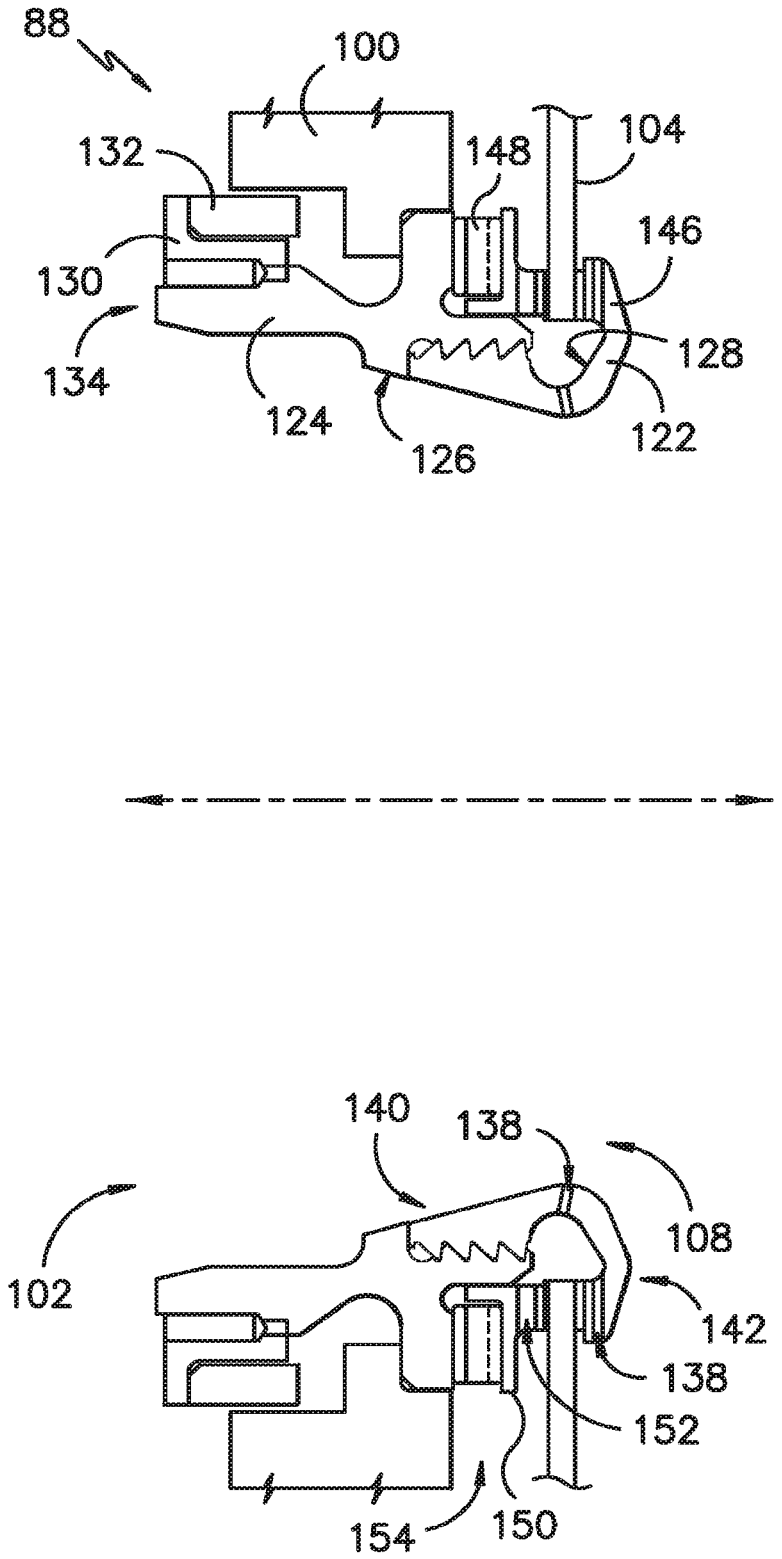
FIG. 4 provides a close-up cross-section view of a portion of a forward end of the combustor assembly of FIG. 2, according to an exemplary embodiment of the present subject matter.

As further illustrated in FIG. 3, a retaining collar 122 extends through each heat shield aperture 108 such that the combustor assembly 80 comprises a plurality of collars 122. Turning to FIG. 4, a close-up cross-section view is provided of a portion of the forward end 88 of combustor assembly 80 according to an exemplary embodiment of the present subject matter. As illustrated, heat shield 104 is positioned adjacent combustor dome 100 such that a heat shield aperture 108 aligns with a dome aperture 102. Collar 122, which extends through the heat shield aperture 108, couples the heat shield 104 to the combustor dome 100. Further, although only a portion of combustor assembly 80 is shown in FIG. 4, it will be appreciated that each aperture 108 of the plurality of heat shield apertures 108 may align with an aperture 102 of the plurality of dome apertures 102, with a collar 122 extending through each heat shield aperture 108 to couple the heat shield 104 to the combustor dome 100.

As further illustrated in FIG. 4, an adapter 124 may be used to couple heat shield 104 to combustor dome 100 using collar 122. More specifically, adapter 124 may be positioned within dome aperture 102 forward of heat shield 104, and adapter 124 may be threaded along an inner surface 126 of the adapter. Collar 122 may be threaded along an outer surface 128 of the collar, and the threads of collar 122 may be configured to engage the threads of adapter 124 such that the collar 122 threadingly engages the adapter 124. In some embodiments, such as the embodiment depicted in FIG. 4, a retainer nut 130 and spacer 132 may be included at a forward end 134 of adapter 124 to help attach adapter 124 to combustor dome 100 at the dome aperture 102.

It will be understood that, although illustrated with respect to one dome aperture 102 and one heat shield aperture 108, the collar 122 and adapter 124 configuration illustrated in FIG. 4 may be used at each of the plurality of dome and heat shield apertures 102, 108. More particularly, in some embodiments, the combustor assembly 80 comprises a plurality of adapters 124 and a plurality of collars 122, and one adapter 124 is attached to the combustor dome 100 at each of a plurality of dome apertures 102. Further, each of the plurality of adapters 124 may be threaded and each of the plurality of collars 122 may be threaded. Each collar 122 of the plurality of collars may threadingly engage an adapter 124 of the plurality of adapters to couple the heat shield 104 to the combustor dome 100.

Figure 5:
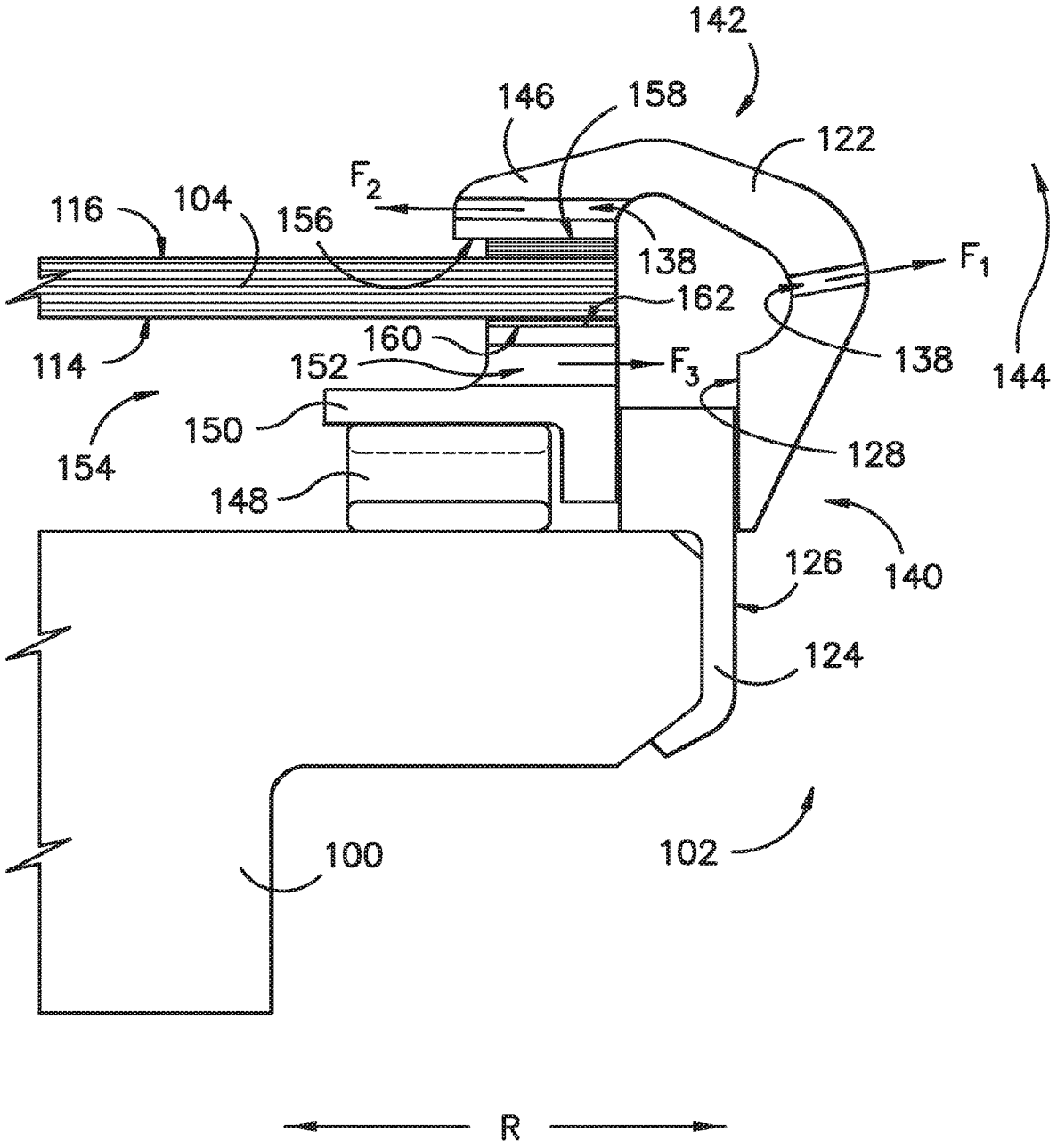
FIG. 5 provides a close-up cross-section view of a portion of a forward end of the combustor assembly of FIG. 2, according to another exemplary embodiment of the present subject matter.

Turning to FIG. 5, a close-up cross-section view is provided of a portion of the forward end 88 of combustor assembly 80 according to another exemplary embodiment of the present subject matter. As shown in FIG. 5, rather than a threaded engagement between collar 122 and adapter 124, collar 122 may be brazed to adapter 124. Further, adapter 124 may be press-fit into dome aperture 102 and swaged into a countersink configuration to attach the adapter 124 to the combustor dome 100. Of course, in embodiments including a plurality of dome apertures 102 and heat shield apertures 104, a plurality of collars 122 and a plurality of adapters 124 may be provided, as described above. Each of the plurality of collars 122 may be brazed to an adapter 124 of the plurality of adapters. Moreover, each adapter 124 of the plurality of adapters may be press-fit and swaged to the combustor dome 100. Thus, FIG. 5 illustrates another way in which the heat shield 104 may be attached to the combustor dome 100.

Figure 6:
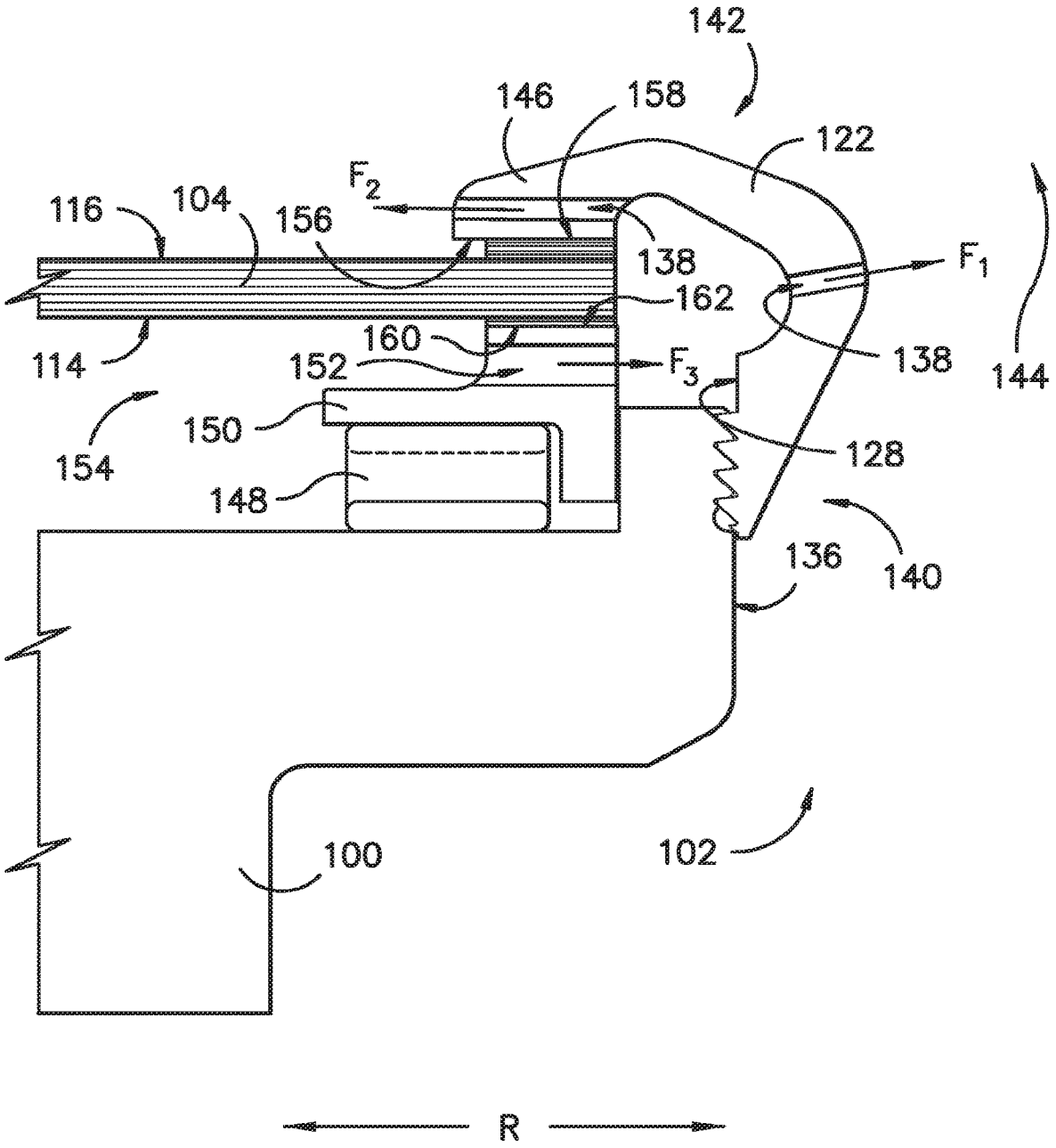
FIG. 6 provides a close-up cross-section view of a portion of a forward end of the combustor assembly of FIG. 2, according to another exemplary embodiment of the present subject matter.

FIG. 6 provides a close-up cross-section view a portion of the forward end 88 of combustor assembly 80 according to yet another exemplary embodiment of the present subject matter. In such embodiments, adapter 124 may be omitted, and collar 122 may attach directly to the combustor dome 100 to couple the heat shield 104 and dome 100. For example, dome aperture 102 of the combustor dome 100 may include an internal perimeter 136, and a portion of the internal perimeter 136 of the dome aperture may be threaded. Collar 122 may be threaded along outer surface 128 of the collar, and the threads of collar 122 may be configured to engage the threads of combustor dome 100 such that the collar 122 threadingly engages the dome 100 at the dome aperture 102. As another example, collar 122 may be brazed to combustor dome 100 along the internal perimeter 136 of dome aperture 102. Further, as described above, where the combustor assembly 80 includes a plurality of dome apertures 102 and heat shield apertures 108, a plurality of collars 122 may be provided, and each collar 122 of the plurality of collars may directly attach to the combustor dome 100 at a dome aperture 102.

As illustrated in FIGS. 4, 5, and 6, in exemplary embodiments of collar 122, the collar defines one or more cooling channels 138, e.g., to permit a flow of cooling fluid through the collar. More particularly, a first cooling channel 138 may be defined at a location between a forward end 140 and an aft end 142 of collar 122. The first cooling channel 138 may be defined at an angle for directing a flow of cooling fluid into the passageway 144 defined by heat shield aperture 108 and dome aperture 102, as shown by the arrow $F_1$. The flow of cooling fluid $F_1$ may impinge on a fuel-air mixer (previously described) positioned within the passageway 144, e.g., to cool the fuel-air mixer. Further, in the depicted embodiments of FIGS. 4, 5, and 6, a second cooling channel 138 is defined adjacent a flange 146 of collar 122 that interfaces with the heat shield 104. As such, the second cooling channel 138 may provide local cooling to the portion of collar 122 that interfaces with heat shield 104, i.e., flange 146 in the depicted embodiments, as well as provide a flow of cooling fluid to the heat shield 104 as shown by the arrow $F_2$. Other cooling channels 138 may be defined in collar 122 as well, or cooling channels 138 may defined in different locations or orientations within the collar 122.

In addition, FIGS. 4, 5, and 6 illustrate that exemplary combustor assemblies 80 may include one or more seals or other mechanisms for providing a tight fit between heat shield 104 and combustor dome 100. For example, in the illustrated embodiments, a wave spring 148 and a loading ring 150 are provided between the combustor dome 100 and the heat shield 104 at each dome aperture 102 and heat shield aperture 108. The wave spring 148 and loading ring 150 help load the heat shield 104 into the collar 122, e.g., the wave spring 148 and loading ring 150 may each apply a force to press the heat shield 104 against the collar 122. By loading the heat shield 104 into the collar 122 (or into each collar 122 of a plurality of collars 122 in embodiments including a plurality of collars), the heat shield 104 may be held in place with respect to combustor dome 100 and/or combustion gas leakage between heat shield 104 and combustor dome 100 may be minimized. Of course, other suitable seals, rings, or other features may be used in place of or in addition to wave spring 148 and loading ring 150 to help hold heat shield 104 in place with respect to combustor dome 100 and to help prevent leakage between the heat shield 104 and the dome 100.

Similar to collars 122, each loading ring 150 may define one or more cooling channels 152, e.g., to permit a flow of cooling fluid through the loading ring. As depicted in FIGS. 4, 5, and 6, the loading ring cooling channels 152 may extend generally along the radial direction R. As further illustrated, a space 154 may be defined between the combustor dome 100 and the heat shield 104, and cooling fluid may be received within the space 154, e.g., to help cool the dome 100 and heat shield 104. As shown by the arrow $F_3$, the loading ring cooling channels 152 may permit a flow of cooling fluid therethrough, e.g., to cool collars 122 and to feed cooling fluid to collar cooling channels 138. It will be appreciated that, like collar cooling channels 138, the loading ring cooling channels 152 illustrated in FIGS. 4, 5, and 6 are only by way of example. Other embodiments may utilize one or more cooling channels 152 that may be defined in different locations and/or orientations within loading ring 150.

As previously described, collar 122 includes a flange 146 that interfaces with the heat shield 104. More particularly, the flange 146 of collar 122 defines an interface surface 156 that is positioned against an aft interface surface 158 defined by the aft surface 116 of heat shield 104. Thus, each collar 122 extends from the aft surface 116 of the heat shield 104 forward toward the combustor dome 100. Moreover, the forward surface 114 of heat shield 104 may define a forward interface surface 160 that is positioned against and interfaces with an interface surface 162 defined by the loading ring 150. As depicted in FIGS. 4, 5, and 6, the heat shield 104 may include a raised area, e.g., formed by laying up additional plies of CMC material as described in greater detail below, that extends about the heat shield aperture 108 on the forward surface 114 and aft surface 116 and defines the heat shield interface surfaces 158, 160. Such a raised area may, e.g., provide a stock of CMC material for machining heat shield aperture 108 or other features of heat shield 104 and/or provide an area on which the collar 122 and loading ring 150 can rub without damaging any environmental barrier coating (EBC) applied to the surfaces 114, 116 of heat shield 104 or without otherwise damaging the heat shield 104.

As the collar 122 and loading ring 150 interface with the heat shield 104, a sliding friction load may be applied at the interface surfaces, i.e., at the interface between surfaces 156 and 158 and between surfaces 160 and 162. For example, in some embodiments, the heat shield 104 is made from a CMC material and the combustor dome, collar 122, and loading ring 150 are each made from a metallic material, such as a high temperature metal alloy. In such embodiments, there is an alpha mismatch between the heat shield 104 and dome 100, the heat shield 104 and collar 122, and the heat shield 104 and loading ring 150, i.e., the coefficient of thermal expansion of the CMC heat shield is different from the coefficient of thermal expansion of the metallic combustor dome, the metallic collar, and the metallic loading ring. Generally, in such embodiments, the dome 100, collar 122, and loading ring 150 will expand at lower temperatures than the CMC heat shield 104. As the dome 100, collar 122, and loading ring 150 thermally expand, e.g., as the combustion temperatures increase, collar 122 and loading ring 150 may slide on heat shield 104, giving rise to a sliding frictional load between the collar and heat shield and between the loading ring and heat shield. In particular, the thermal growth difference between the metallic combustor dome 100 and annular CMC heat shield 104 may be the greatest contributor to movement between the collar 122 and the ring-shaped heat shield 104. In other embodiments in which the heat shield 104 is not a full annular shape, other factors may contribute to movement between collar 122 and heat shield 104 such that the alpha mismatch between the dome 100 and the heat shield 104 is not the greatest contributor to movement between the collar 122 and heat shield 104.

To combat any negative effects of movement between the heat shield 104, collar 122, and loading ring 150, the collar interface surface 156, loading ring interface surface 162, and heat shield interface surfaces 158, 160 may be configured to bear such frictional load without damaging collar 122, loading ring 150, or heat shield 104. For example, in some embodiments, a wear coat may be applied to the collar interface surface 156 to minimize the effects of any sliding friction between the heat shield 104 and collar 122. Further, as described, the heat shield interface surfaces 158, 160 may be defined on a raised area of heat shield 104 to minimize any wear on the heat shield.

Figure 7:
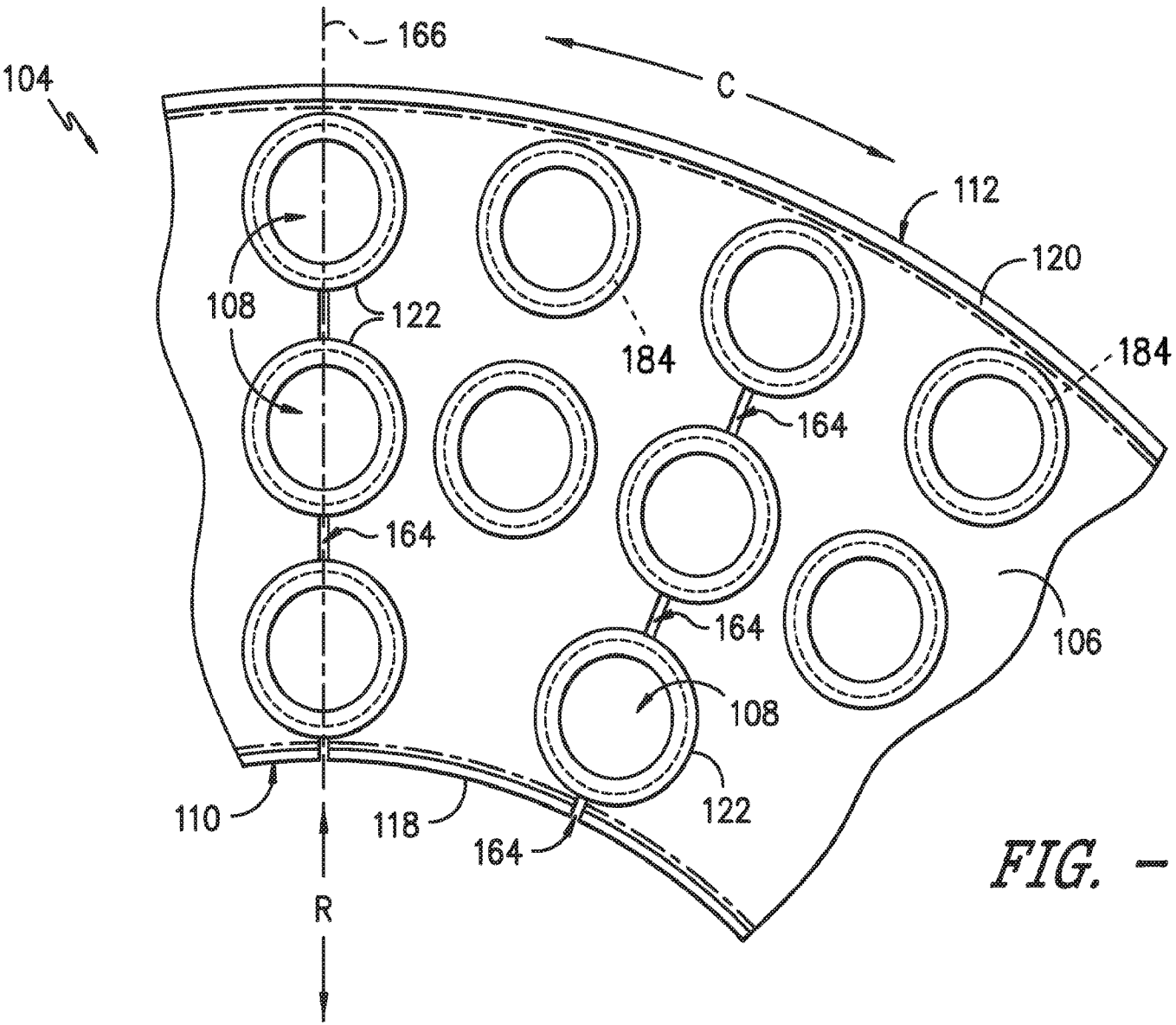
FIG. 7 provides an aft end view of a portion of a heat shield of the combustor assembly of FIG. 2, according to another exemplary embodiment of the present subject matter.

Turning now to FIG. 7, an aft end view is provided of a portion of a CMC heat shield 104 according to another exemplary embodiment of the present subject matter. As illustrated in FIG. 7, a plurality of slots 164 may be defined through the heat shield 104. The slots 164 may, e.g., provide thermal stress relief to the heat shield 104. Further, although illustrated as radial slots 164, i.e., each illustrated slot 164 extends generally along the radial direction R or a radial line 166 that extends through the axial centerline 12 (FIG. 1), one or more slots 164 also may be defined along the circumferential direction C. In some embodiments, slots 164 may be defined by cutting the CMC heat shield 104, but the slots 164 may be defined in other ways as well.

Figure 8:
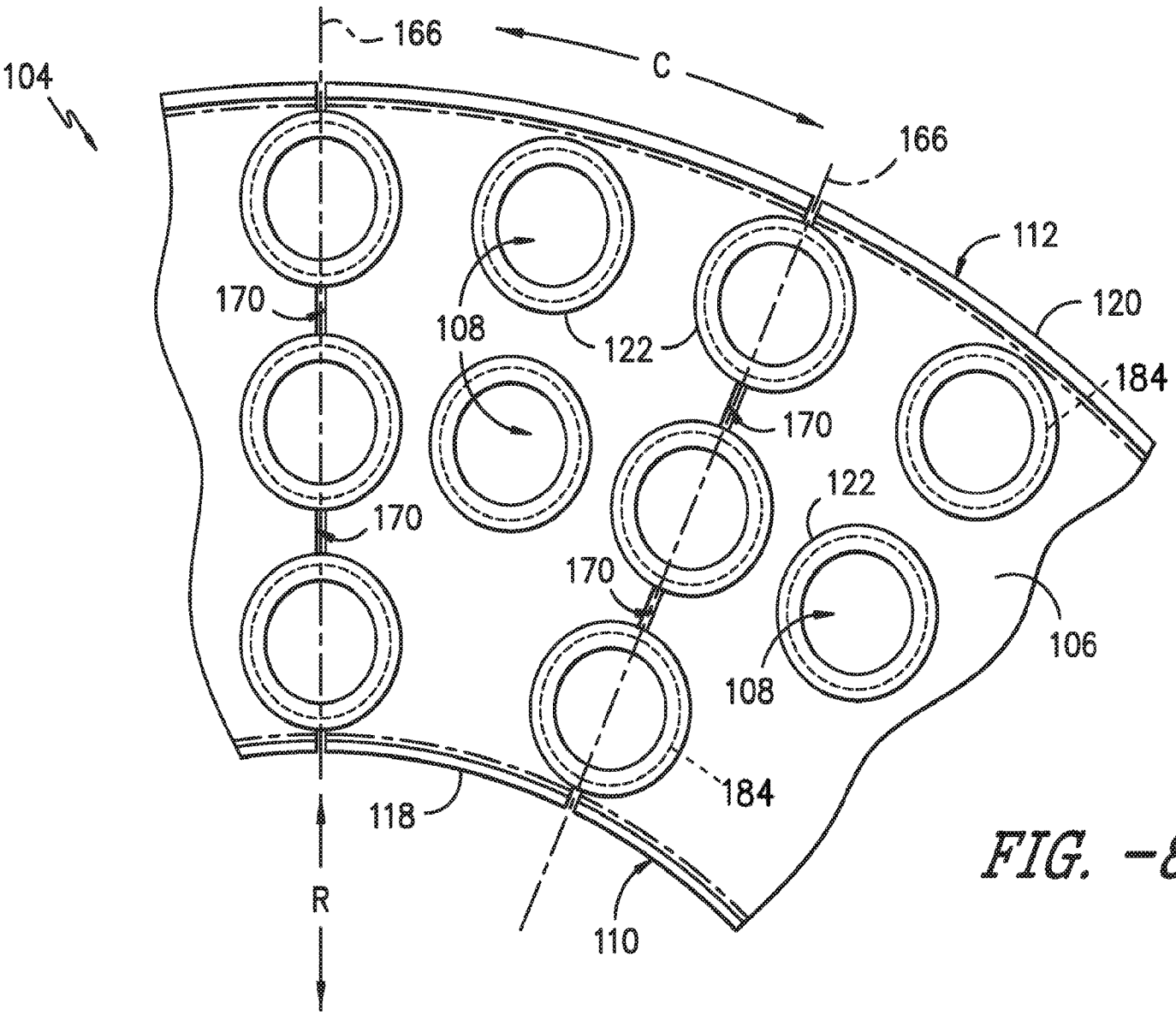
FIG. 8 provides an aft end view of a portion of a heat shield of the combustor assembly of FIG. 2, according to another exemplary embodiment of the present subject matter.

Referring to FIG. 8, in other exemplary embodiments of heat shield 104, the annular heat shield 104 is segmented along a plurality of radial lines 166 into a plurality of radial segments 168. Each radial segment 168 of heat shield 104 comprises a plurality of heat shield apertures 108, and in the illustrated embodiment, a collar 122 is positioned within each aperture 108 of the plurality of heat shield apertures 108. Further, each radial segment 168 comprises a portion of heat shield body 106, inner wing 118, and outer wing 120. Moreover, each heat shield segment 168 comprises an edge 170 positioned next to an adjacent heat shield segment 168, i.e., adjacent heat shield segments 168 are aligned along edges 170 to define annular heat shield 104. It will be appreciated that the radial segments 168 also may include one or more slots 164, e.g., circumferential slots 164 that are defined along the circumferential direction C.

Figure 9:
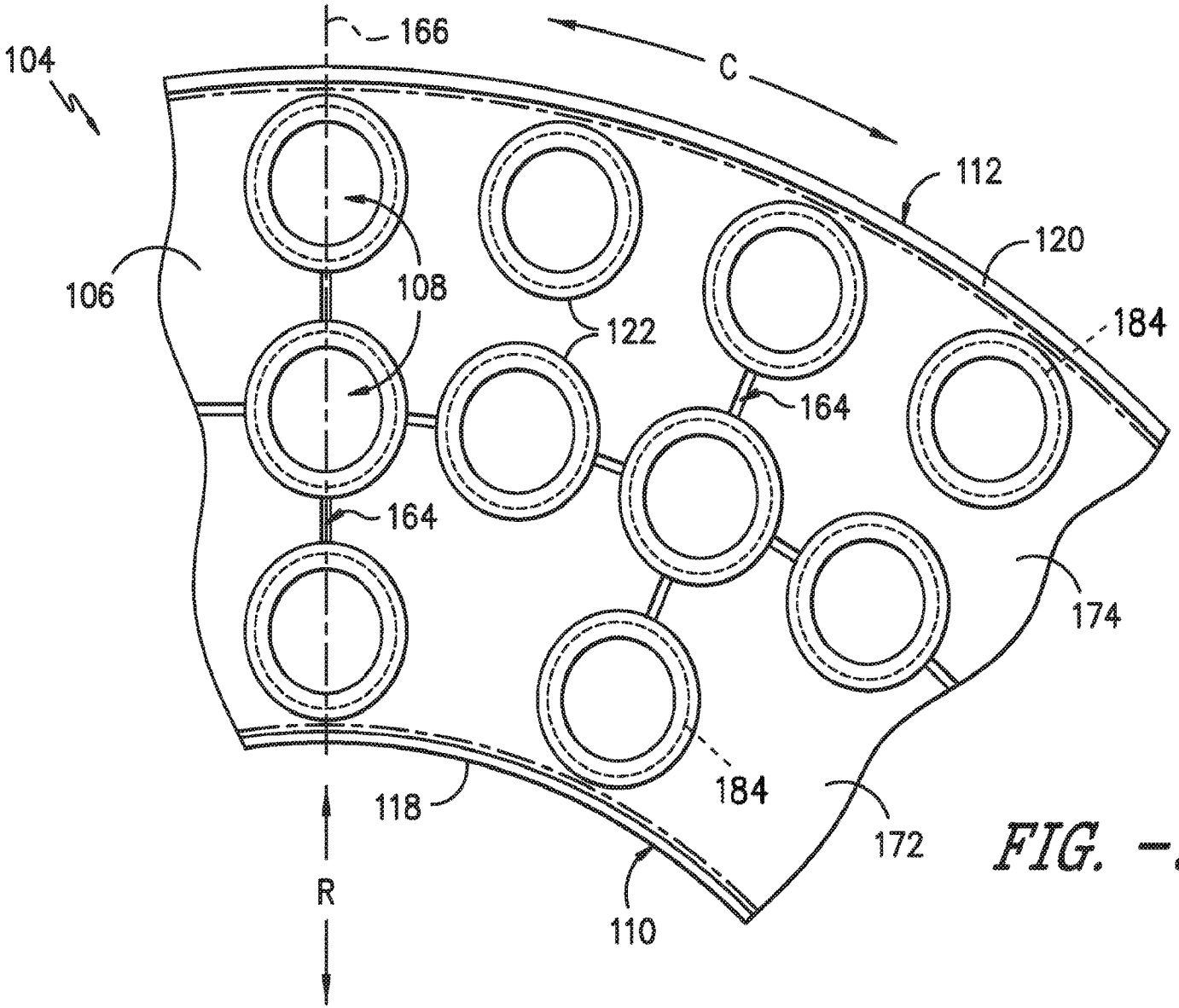
FIG. 9 provides an aft end view of a portion of a heat shield of the combustor assembly of FIG. 2, according to another exemplary embodiment of the present subject matter.

In yet other exemplary embodiments of heat shield 104 illustrated in FIG. 9, the annular heat shield 104 is circumferentially segmented into one or more rings. For example, as illustrated in FIG. 9, heat shield 104 is segmented along the circumferential direction C into an inner heat shield ring 172 and an outer heat shield ring 174. Each of the inner heat shield ring 172 and outer heat shield ring 174 comprise a plurality of the heat shield apertures 108, and in the illustrated embodiment, a collar 122 is positioned within each aperture 108 of the plurality of heat shield apertures 108. Moreover, each heat shield ring 172, 174 comprises a portion of heat shield body 106, and the inner heat shield ring 172 includes inner wing 118 of heat shield 104 and the outer heat shield ring 174 includes the outer wing 120. Additionally, inner heat ring 172 includes an edge 176 that is positioned next to an edge 178 of outer heat shield ring 174 to align the inner and outer heat shield rings 172, 174 and thereby define annular heat shield 104. Further, each heat shield ring 172, 174 also may include one or more slots 164, e.g., radial slots 164 that are defined along one or more radial lines 166, but in other embodiments, each heat shield ring 172, 174 also may include one or more circumferential slots 164.

Figure 10:
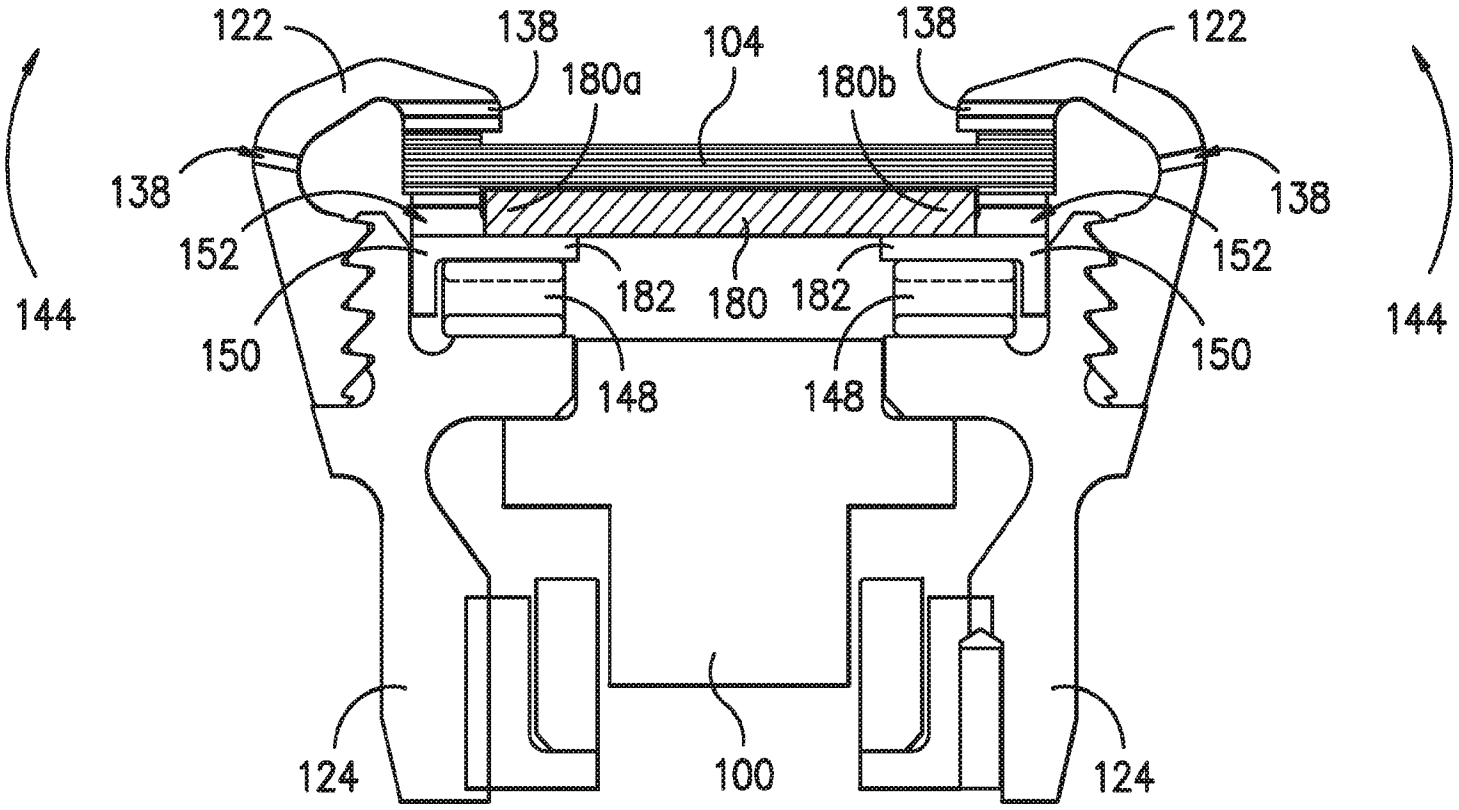
FIG. 10 provides a close-up cross-section view of a portion of a forward end of the combustor assembly of FIG. 2, according to another exemplary embodiment of the present subject matter.

Referring now to FIG. 10, one or more seals 180 may be positioned upstream of each slot 164, as well as along edges 170 of radial heat shield segments 168 and edges 176, 178 of inner and outer heat shield rings 172, 174. That is, a seal 180 may be positioned between heat shield 104 and combustor dome 100 at each break or space in the heat shield. As such, each seal 180 may help, e.g., prevent combustion gas leakage along edges 170, 176, 178 and at slots 164. In the embodiment illustrated in FIG. 10, loading rings 150 each define a shoulder 182 extending about an outer perimeter of the loading ring. A first end 180*a* of seal 180 is disposed on the shoulder 182 of one loading ring 150, and a second end 180*b* of seal 180 is disposed on the shoulder 182 of an adjacent loading ring 150 such that the loading rings 150 support the seal 180.

Figure 11:
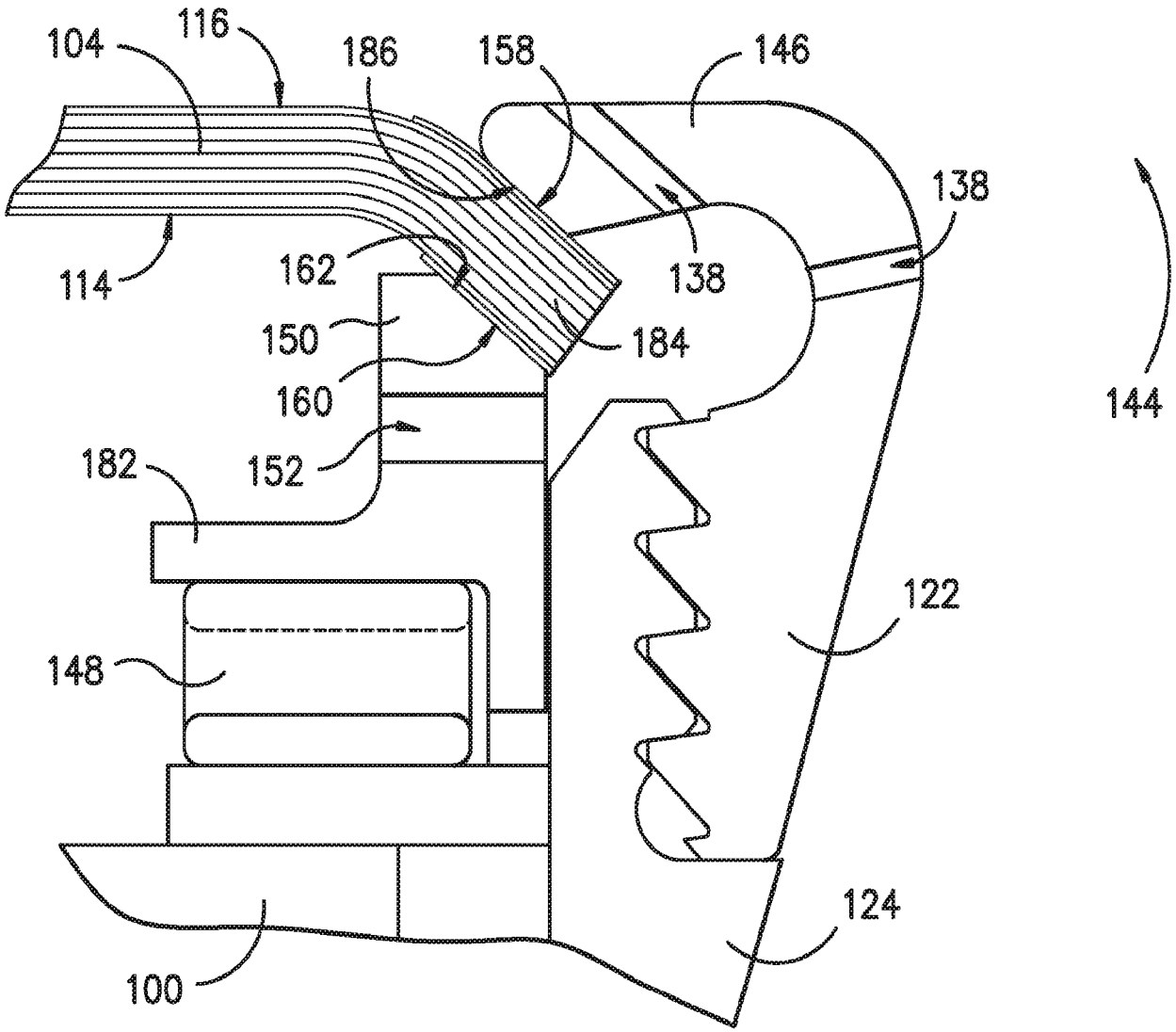
FIG. 11 provides a close-up cross-section view of a portion of a forward end of the combustor assembly of FIG. 2, according to another exemplary embodiment of the present subject matter.

FIG. 11 provides a schematic, cross-sectional view of a portion of a combustor assembly 80 according to another exemplary embodiment of the present subject matter. As depicted in FIG. 11, the heat shield 104 includes a rim 184 at each heat shield aperture 108. In some embodiments, such as the depicted exemplary embodiment, the rim may be angled inward toward the passageway 144 such that the rim has a generally conical shape. That is, the heat shield apertures 108 may be countersunk such that collars 122 are countersunk when positioned within apertures 108. As such, the aft end 142 of each collar 122 generally may be aligned with the aft surface 116 of heat shield 104. The flange 146 may be angled or beveled along its outer edge 186 such that the outer edge 186 of each collar flange 146 rests against a rim 184 of the heat shield 104 when the collars 122 are positioned within the heat shield apertures 108.

Figure 12:
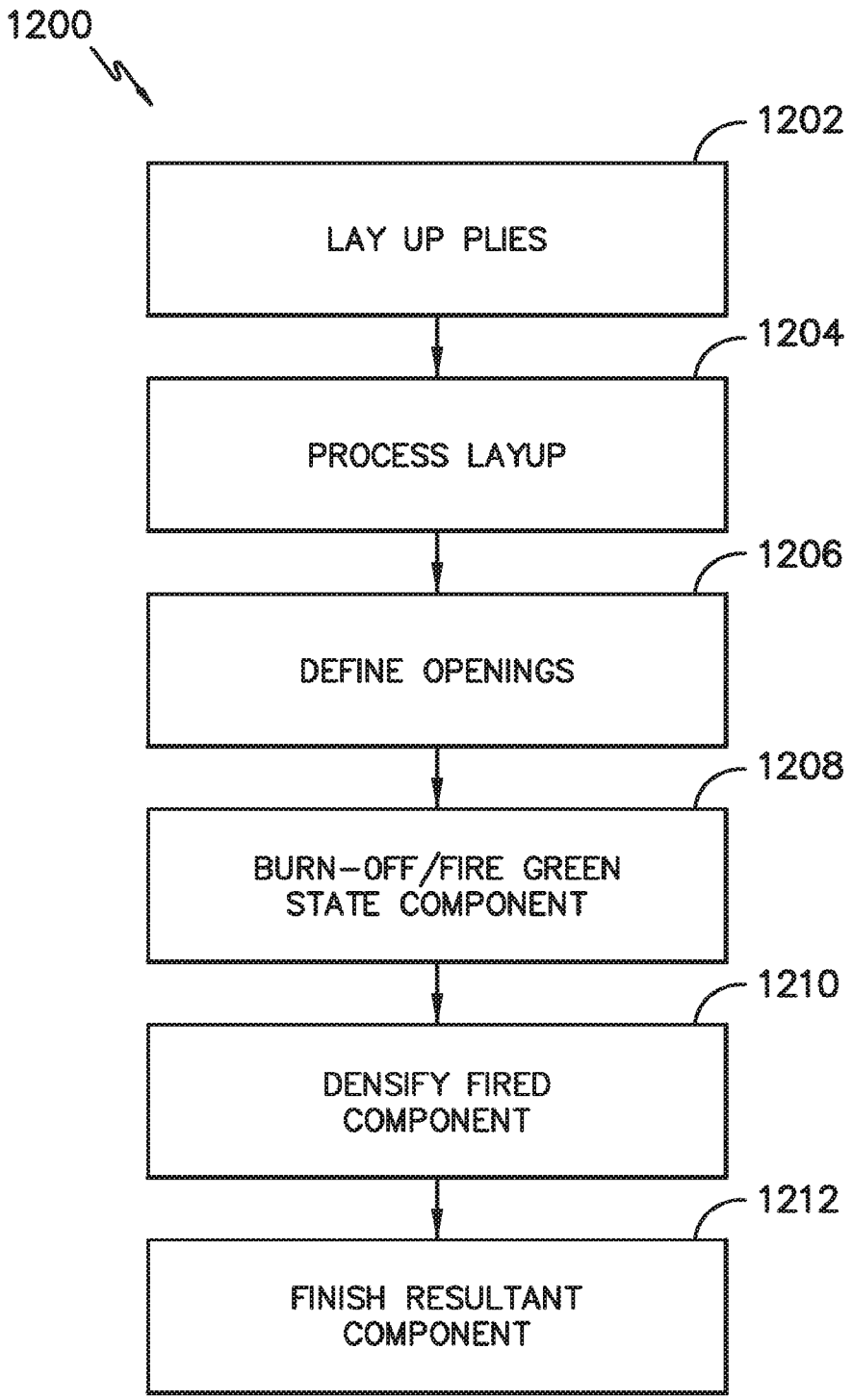
FIG. 12 provides a chart illustrating a method for forming a ceramic matrix composite heat shield according to an exemplary embodiment of the present subject matter.

FIG. 12 provides a flow diagram illustrating a method 1200 for forming a CMC component, such as a CMC heat shield, according to an exemplary embodiment of the present subject matter. As previously described, heat shield 104 may be made from a CMC material, which is a non-metallic material having high temperature capability. As such, CMC materials may be beneficial for use in forming parts of combustor assembly 80, e.g., heat shield 104, that are exposed to the hot combustion gases. However, although method 1200 is described below with respect to forming a CMC heat shield 104, it will be appreciated that method 1200 may be applicable to forming other components of combustor assembly 80 and turbofan engine 10.

As shown at 1202 in FIG. 12, a plurality of plies of a CMC material for forming the CMC component may be laid up to form a CMC component preform having a desired shape or contour. It will be appreciated that the plurality of CMC plies forming the preform may be laid up on a layup tool, mold, mandrel, or another appropriate device for supporting the plies and/or for defining the desired shape. The desired shape of CMC component preform may be a desired shape or contour of the resultant CMC component. As an example, the plies may be laid up to define a shape of CMC component preform that is the shape of heat shield 104, such as the heat shield shown in FIG. 3. Further, laying up the plurality of plies may include stacking plies to define the raised areas defining heat shield interface surfaces 158, 160 such that the raised areas comprise a stack of plies of the CMC material. Laying up the plurality of plies to form the heat shield preform may include defining other features of heat shield 104 as well. The plurality of plies of CMC material for forming the exemplary heat shields 104 described above may have more reasonable or less complex ply shapes than known or former heat shield configurations, which may simplify the layup process and thereby simplify the fabrication of CMC heat shields 104.

After the plurality of plies is laid up, the plies may be processed, e.g., compacted and cured in an autoclave, as shown at 1204 in FIG. 12. After processing, the plies form a green state CMC component, e.g., a green state CMC heat shield 104. The green state CMC component is a single piece component, i.e., curing the plurality of plies joins the plies to produce a CMC component formed from a continuous piece of CMC material. The green state component then may undergo firing (or burn-off) and densification, illustrated at 1208 and 1210 in FIG. 12, to produce a final CMC component. In an exemplary embodiment of method 1200, the green state component is placed in a furnace with silicon to burn off any mandrel-forming materials and/or solvents used in forming the CMC plies, to decompose binders in the solvents, and to convert a ceramic matrix precursor of the plies into the ceramic material of the matrix of the CMC component. The silicon melts and infiltrates any porosity created with the matrix as a result of the decomposition of the binder during burn-off/firing; the melt infiltration of the CMC component with silicon densifies the CMC component. However, densification may be performed using any known densification technique including, but not limited to, Silcomp, melt-infiltration (MI), chemical vapor infiltration (CVI), polymer infiltration and pyrolysis (PIP), and oxide/oxide processes. In one embodiment, densification and firing may be conducted in a vacuum furnace or an inert atmosphere having an established atmosphere at temperatures above 1200° C. to allow silicon or another appropriate material or materials to melt-infiltrate into the component. In some embodiments, as shown at 1212 in FIG. 12, after firing and densification the CMC component may be finish machined, if and as needed, and/or coated with an environmental barrier coating (EBC), e.g., on forward and aft surfaces 114, 116.

Optionally, as shown at 1206 in FIG. 12, before firing and densification the green heat shield 104 may be machined, e.g., to define heat shield apertures 108 and/or slots 164 in the heat shield. More particularly, when the CMC heat shield 104 is in a green state after processing, the green state component retains some flexibility and malleability, which can assist in further manipulation of the component. For example, the malleability of the green state heat shield 104 may help in machining heat shield apertures 108 and/or slots 164 in the heat shield such that these openings are machined in the green state heat shield rather than after the heat shield has undergone firing and densification. The apertures 108 and/or slots 164 may be formed in the green state heat shield 104 using one or more of laser drilling, electrical discharge machining (EDM), laser cutting, precision machining, or other machining methods. In other embodiments, the heat shield apertures 108 and/or slots 164 may be defined in the CMC plies such that the apertures 108 and/or slots 164 are defined during the ply layup portion of method 1200 shown at 1202 in FIG. 12. In still other embodiments, the apertures 108 and/or slots 164 may be defined in the heat shield 104 after the heat shield has been fired and densified, e.g., using one or more of laser drilling, EDM, laser cutting, precision machining, or the like.

Method 1200 is provided by way of example only. For example, other processing cycles, e.g., utilizing other known methods or techniques for compacting and/or curing CMC plies, may be used. Further, the CMC component may be post-processed or densified using any appropriate means.

Alternatively, any combinations of these or other known processes may be used as well. Moreover, although described with respect to heat shield 104 generally, it will be appreciated that the foregoing method 1200 also may be used to form radial heat shield segments 168, which together define heat shield 104 in some embodiments, or to form inner and outer heat shield rings 172, 174, which together define heat shield 104 in other embodiments. Method 1200 may be utilized to form other CMC components as well.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A combustor assembly for a gas turbine engine, comprising:

a combustor liner defining a combustion chamber;

an annular combustor dome positioned at a forward end of the combustor liner, the annular combustor dome defining a plurality of dome apertures;

an annular heat shield positioned between the annular combustor dome and the combustion chamber, the annular heat shield defining a plurality of heat shield apertures and a plurality of slots, the plurality of heat shield apertures aligned with the dome apertures;

a plurality of adapters, one adapter attached to the annular combustor dome at each dome aperture, the plurality of adapters positioned forward of the annular heat shield; and a plurality of collars, one collar extending through each heat shield aperture to couple the annular heat shield to the annular combustor dome, wherein each slot of the plurality of slots extends from a respective heat shield aperture of the plurality of heat shield apertures toward an adjacent heat shield aperture of the plurality of heat shield apertures such that the slot extends from a respective collar of the plurality of collars that extends through the respective heat shield aperture to a collar of the plurality of collars that extends through the adjacent heat shield aperture.

2. The combustor assembly of claim 1, wherein each adapter of the plurality of adapters is press-fit within a respective one of the plurality of dome apertures, and wherein a respective one of the plurality of collars is brazed to each adapter.

3. The combustor assembly of claim 1, wherein the annular combustor dome is threaded at each dome aperture of the plurality of dome apertures, wherein each collar of the plurality of collars is threaded, and wherein each collar of the plurality of collars threadingly engages the annular combustor dome at a respective one of the plurality of dome apertures.

4. The combustor assembly of claim 1, wherein the annular heat shield comprises:

an annular body, the annular body defining the plurality of heat shield apertures, the annular body having an inner perimeter, an outer perimeter, a forward surface, and an aft surface;

an inner wing extending axially aft and circumferentially along the inner perimeter of the annular body; and an outer wing extending axially aft and circumferentially along the outer perimeter of the annular body.

5. The combustor assembly of claim 4, wherein the annular heat shield is formed from a ceramic matrix composite material.

6. A combustor assembly for a gas turbine engine, comprising:

a combustor liner defining a combustion chamber, the combustor liner including an inner liner and an outer liner;

an annular combustor dome positioned at a forward end of the combustor liner, the annular combustor dome defining a plurality of dome apertures;

a ceramic matrix composite (CMC) heat shield positioned between the annular combustor dome and the combustion chamber, the CMC heat shield comprising:

an annular body, the annular body defining a plurality of heat shield apertures, the plurality of heat shield apertures aligned with the dome apertures, the annular body having an inner perimeter, an outer perimeter, a forward surface, and an aft surface, an inner wing extending axially aft and circumferentially along the inner perimeter of the annular body, and an outer wing extending axially aft and circumferentially along the outer perimeter of the annular body;

a plurality of adapters, one adapter attached to the annular combustor dome at each dome aperture, the plurality of adapters positioned forward of the CMC heat shield; and a plurality of collars, one collar extending through each heat shield aperture to couple the CMC heat shield to the annular combustor dome, wherein the CMC heat shield extends radially from the inner liner to the outer liner such that the inner wing of the CMC heat shield overlies a portion of the inner liner and the outer wing of the CMC heat shield overlies a portion of the outer liner.

* * * * *